US005810563A

United States Patent [19]

Volkmann

[11] Patent Number: 5,810,563

[45] Date of Patent: Sep. 22, 1998

[54] EJECTOR PUMP HAVING FLOW DIRECTING PROFILES

[76] Inventor: Thilo Volkmann, Zum Vulting 12, D-59514 Welver, Germany

[21] Appl. No.: 684,181

[22] Filed: Jul. 19, 1996

Related U.S. Application Data

[62] Division of Ser. No. 605,704, Feb. 23, 1996, Pat. No. 5,593,284, which is a continuation of Ser. No. 379,511, filed as PCT/EP93/02084 Aug. 5, 1993 published as WO94/03732 Feb. 17, 1994 , abandoned.

[30] Foreign Application Priority Data

Aug. 6, 1992 [DE] Germany ..... 9210497 U

[51] Int. Cl.[6] ..... F04F 5/00

[52] U.S. Cl. ..... 417/174; 417/182; 417/176; 417/151

[58] Field of Search ..... 417/151, 174, 417/169, 176

[56] References Cited

U.S. PATENT DOCUMENTS

| | | | |
|---|---|---|---|
| 597,212 | 1/1898 | Ahrbecker | 417/169 |
| 636,333 | 11/1899 | Guethler | 417/174 |
| 3,101,169 | 8/1963 | Smith, Jr. | 417/176 |
| 3,255,708 | 6/1966 | Williams | 417/176 |
| 3,371,618 | 3/1968 | Chambers | 417/174 |
| 3,442,086 | 5/1969 | Nieman | 417/174 |
| 3,460,746 | 8/1969 | Green et al. | 417/174 |
| 3,640,645 | 2/1972 | Forsythe | 417/174 |
| 3,768,394 | 10/1973 | Powlesland | 417/176 |
| 4,917,152 | 4/1990 | Decker | 417/174 |
| 4,938,665 | 7/1990 | Volkmann | 417/174 |
| 5,584,668 | 12/1996 | Volkmann | 417/174 |

FOREIGN PATENT DOCUMENTS

| | | | |
|---|---|---|---|
| 2577284 | 7/1986 | France . | |
| 2058392 | 5/1972 | Germany . | |
| 297550 | 1/1989 | Germany . | |
| 3420652 | 7/1991 | Germany . | |
| 4011218 | 10/1991 | Germany . | |
| 4225956 | 2/1994 | Germany . | |
| 61-4900 | 1/1986 | Japan | 417/174 |
| 187065 | 10/1956 | Norway | 417/182 |
| 308231 | 8/1971 | U.S.S.R. . | |
| 1675588 | 9/1991 | U.S.S.R. . | |

*Primary Examiner*—Timothy Thorpe
*Assistant Examiner*—Ted Kim
*Attorney, Agent, or Firm*—Vickers, Daniels & Young

[57] ABSTRACT

An ejector pump for the transport of materials or mixtures of materials capable of flowing with the aid of a fluid driving medium is provided. The ejector pump includes at least one flow management profile which is placed in the flow channel of the ejector pump and which displaces the fluid that is flowing against the profile in a lateral direction component away from the original direction of flow. Therefore, the fluid in the middle of the flow channel makes its way closer to one of the flow channel walls thus limiting the areas of turbulence that occur during the mixing of material that is to be transported with the driving medium.

6 Claims, 3 Drawing Sheets

EJECTOR PUMP HAVING FLOW DIRECTING PROFILES

Figure 1:
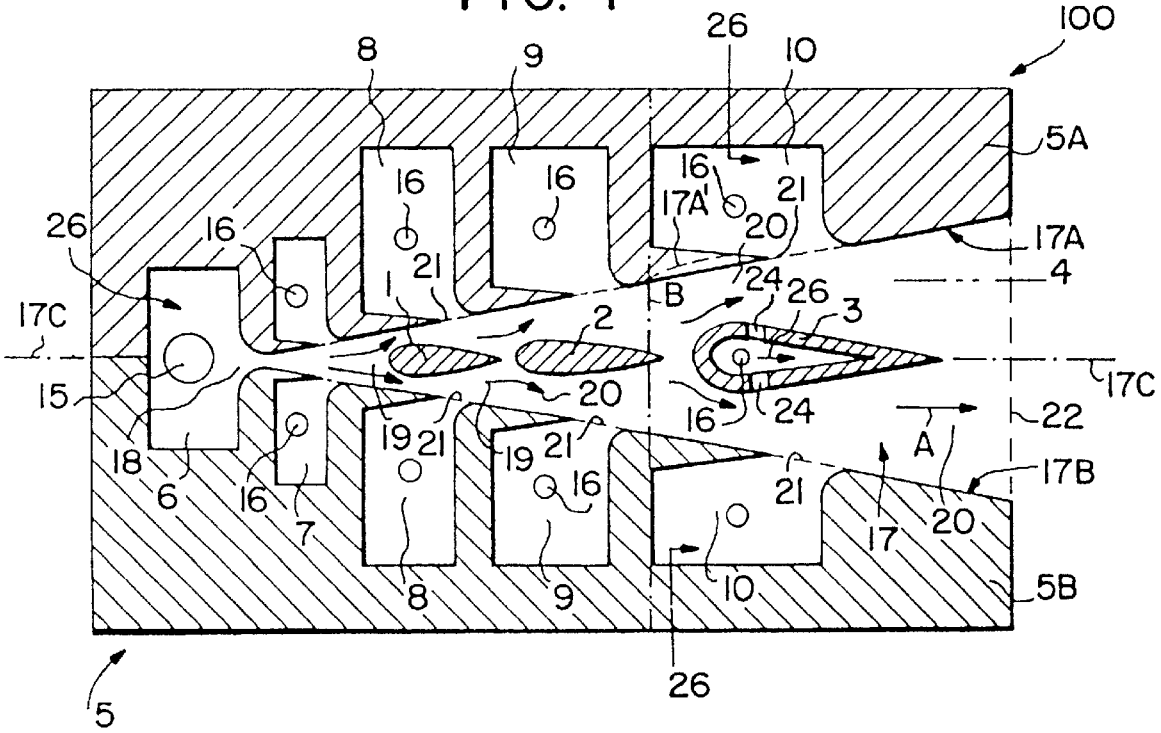

This is a division, of application Ser. No. 605,704 filed Feb. 23, 1996 now U.S. Pat. No. 5,593,284, which is a continuation of 08/379,511 filed Feb. 1, 1995 now abd. which is a 371 of PCT/EP93/0208 filed Aug. 5, 1993 published as WO94/03732 Feb. 17. 1994.

The invention pertains to an ejector pump in accordance with the introductory clause of claim 1, in particular, a multistage injector pump.

Injector pumps of this type have been known for a long time, from FR-A1-2 577 284, for example, and are used both for the production of a vacuum as well as for the transporting of materials or mixtures of materials that are capable of flowing. To achieve a high efficiency, particular when there are large volumes to be pumped, a multistage form of implementation of the injection pump is known, in which the pump stages lie one after the other in the flow channel. This has the advantage, among others, that the flow energy of the driving medium, which can be either gaseous or liquid, is used until the velocity of flow has fallen below a level which no longer has an economically useful value in terms of structural effort.

With ejector pumps, in particular those of the multistage design, there exists the problem that during the mixing of the driving medium with the material that is to be transported, areas of turbulence occur that reduce the efficiency of the pumping capability, particularly in the subsequent pumping stages and in their associated mixing zones. In order to solve this problem, it is known that in order to counter the effects of the turbulence, the overall length of the flow channel in the region of the mixing zone and the diffuser is extended to the extent that each of the areas of turbulence can subside to a level that is tolerable. In this regard, the length of the zone that acts on the flow in a smoothing fashion is proportional to the cross-sectional area of the flow channel in the area in which the flow is disturbed. However, the large overall lengths themselves represent a significant added expense in terms of construction.

While in the case of ejector pumps in which the flow channel is circular in cross-section and in which the pass-through slot for the medium that is to be transported lies on a circum-ferential line of the flow channel cross-sectional area, as is the case with FR-A1-2 577 284, the residual energy of the driving medium can be kept relatively small, primarily in the case of ejector pumps with a rectangular cross-section that is relatively flat in comparison with its width, as is the case with the so-called flat-channel ejector pumps, the additional problem arises that the utilization of the residual energy of the driving medium is especially difficult, and is relatively unsatisfactory even with great structural efforts. Flat-channel ejector pumps of that type are known from EP-A-0 297 550.

In order to increase the suction power of an ejector pump with circular jet nozzles that are placed axially one after the other, in DE-A1-4 011 218 an annular implementation of such jets is introduced. This is acheived by means of an arbor that passes through the jets concentrically in the axial direction and that is uninterrupted through the entire length of the channel. Taking into account the rotational symmetry, this corresponds to a narrowing of the flow channel in the case of flat-channel ejector pumps, so that their flow channel is given, in comparison with the width, a flatter cross-section. In the case of generic ejector pumps, a decisive improvement in the suction power cannot be achieved by means of these measures, particularly in the case of flat-channel ejection pumps.

Starting from that point, the invention performs the task of achieving more favorable flow characteristics in the flow channel for generic ejector pumps.

This task is performed by means of an ejector pump with the characterizing features of claim 1.

By means of the flow management profiles that are provided in accordance with the invention, areas of turbulence that occur during the mixing of the material that is to be transported with the driving medium can be kept relatively small. As a result, it becomes possible to keep the flow channel length, and thus the overall, length of the pump, relatively small. In the case of multistage ejector pumps, as a result of the reduction of the areas of turbulence, their harmful effects on the subsequent pumping stages is reduced as well, and in particular, on the subsequent mixing zones in the flow channel. On the other hand, with the flow management profiles in accordance with the invention it is also possible to improve the effectiveness of the driving medium; in particular, the residual energy of the driving medium can be reduced with relatively little effort, and the pumping efficiency thus increased. The profiles and/or dividing wall in accordance with the invention have a particularly advantageous effect on those ejector pumps, in particular, multistage ejector pumps, in which the flow channel cross-section is comparatively flat and wide, as is especially the case with the so-called flat-channel ejector pumps, and even more specifically, those in which the cross-sectional areas are curved, in particular, lie on a circular area as is the case with DE-A1-34 20 652.

It is now possible, in a number of different ways, to shape the profiles and/or dividing walls in accordance with the invention and to place them in the flow channel; in particular, it is possible to make use of variously shaped and variously placed profiles and/or dividing walls in one and the same channel, as is explained by way of example in the implementation examples.

In the case of a first form of implementation of the profiles in accordance with the invention, they are configured as an elongated profile that has a cross-section which preferably has a shape that is similar to that of an airfoil. This profile is placed within the flow channel in such a way that its direction of longitudinal extension runs approximately perpendicular to the direction in which the flow channel runs, and thus runs approximately perpendicular to the primary direction of flow of the fluid (driving medium and the material that is to be transported) in the flow channel. A flow management profile of such a type of necessity has a certain volume, and displaces the fluid that is flowing against the profile and guides it with a lateral direction component away from its original direction of flow, so that the fluid in the middle—depending in part on its inertia—makes its way closer to the wall of the flow channel and thus brings about at the pass-through slot of the subsequent suction stage a higher fluid velocity of flow. A contraction of the cross-section in comparison with a flow channel without a flow management profile of such a type is as a rule avoided in this way.

A profile of such a type makes it possible to construct flat-channel ejector pumps with improved efficiency which can be manufactured in a particularly economical manner, namely in an extrusion or continuous casting process (see form of implementation in accordance with FIG. 1). Profiles of such a type can also be used advantageously, however, in flat-channel ejector pumps that exhibit an annular flow channel which is directed radially towards the outside and which is known from, for one, DE-A1-34 20 652 for a single-stage ejector pump, and from the German registered utility model (registered utility model application G 92 10 496) for multistage ejector pumps (see forms of implementation in accordance with FIG. 3 and FIG. 6).

With profiles of such a type, a number of particularly advantageous measures can be taken. Thus, the flow management profiles in accordance with the invention can exhibit a symmetrical and/or airfoil-like profile and can be integrated into flat-channel ejector pumps that are constructed symmetrically with respect to the longitudinal center plane of the flow channel, that is, they are equipped on both sides of the flat channel with suction chambers and pass-through slots for the fluid to be transported that lie opposite each other, as is for example the case with the implementation example in accordance with FIGS. 1 and 2.

The positioning of the profile has proven to be especially advantageous.

In the case of multistage ejector pumps, it is to be recommended that the profile cross-sections of the profiles that are arranged one after the other in the direction of flow be increasingly enlarged in size.

It is suggested as being particularly effective, that profiles or dividing walls that are hollow inside be provided, and that the hollow space be joined with the flow channel on the one side and on the other, with the inlet for the material that is to be transported. As a result of this, the profile or diving wall works entirely or additionally as a suction chamber.

The dividing wall in accordance with the invention (placed along side), is configured as an elongated dividing wall which is approximately parallel to the flow and which divides the flow channel cross-section into approximately parallel partial flow channels. This measure can also be realized both in the case of cross-sectional areas that are straight as well as in the case of cross-sectional areas that are circular (see FIGS. 2 and 3). It has been shown that flow management profiles of such a type significantly reduce the areas of turbulence in the mixing zone. This has an especially beneficial effect primarily in the case of multistage ejector pumps, in particular, those of the flat-channel type.

For the further improvement of the flow conditions—by means of the reduction of the cross-sections of the inlets as well—in flat-channel injector pumps, it can be advantageous to configure and/or to place the dividing walls in such a way that the flow channels run from one another in the direction of flow in an approximately conical manner. This can be realized in a simple way in accordance with claim 8 by virtue of the fact that the dividing walls taper in the direction in which the flow channels run.

An ejector pump in accordance with the invention can be manufactured in an especially cost-effective way if it is built up from individual ejector pump modules in accordance with claim 9. It is also possible as a result of the modular design, for ejector pumps of different capacities to be produced through the joining together of a varying number of ejector pump modules, without new tools being necessary for this purpose. The ejector pump modules can be designed in such a way that they are suitable for the building up of flat-channel injection pumps (see implementation form in accordance with FIG. 4), or in such a way that by means of the joining together of several ejector pump modules to each other, a radial ejector pump is created that forms a segment of a circle or that extends over a full circle (see form of implementation in accordance with FIG. 5).

The components which are named above and which are claimed and described in the implementation examples and which are to be used in accordance with the invention, are not subject to any special exception conditions with respect to their size, shape, choice of material, and engineering design, so that the selection criteria that are known in the area of application under discussion can be applied with no restrictions.

Figure 2:
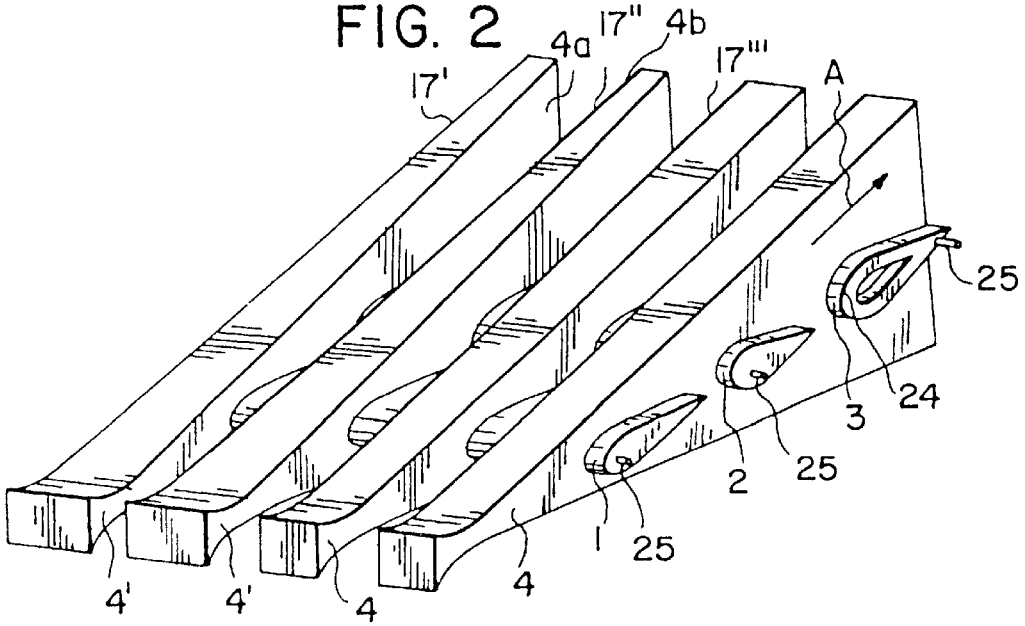
Figure 3:
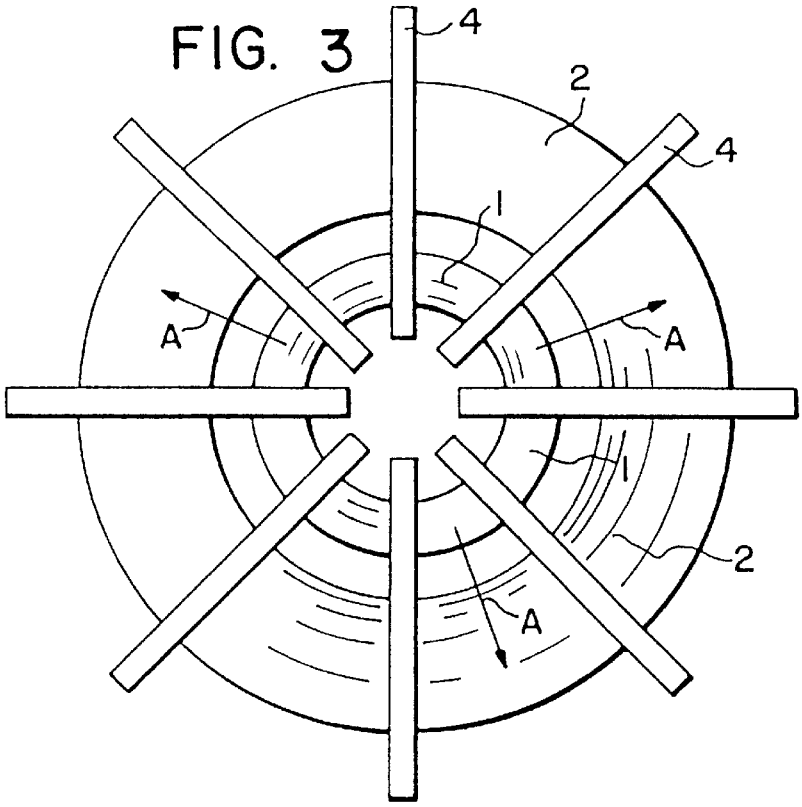
Figure 4:
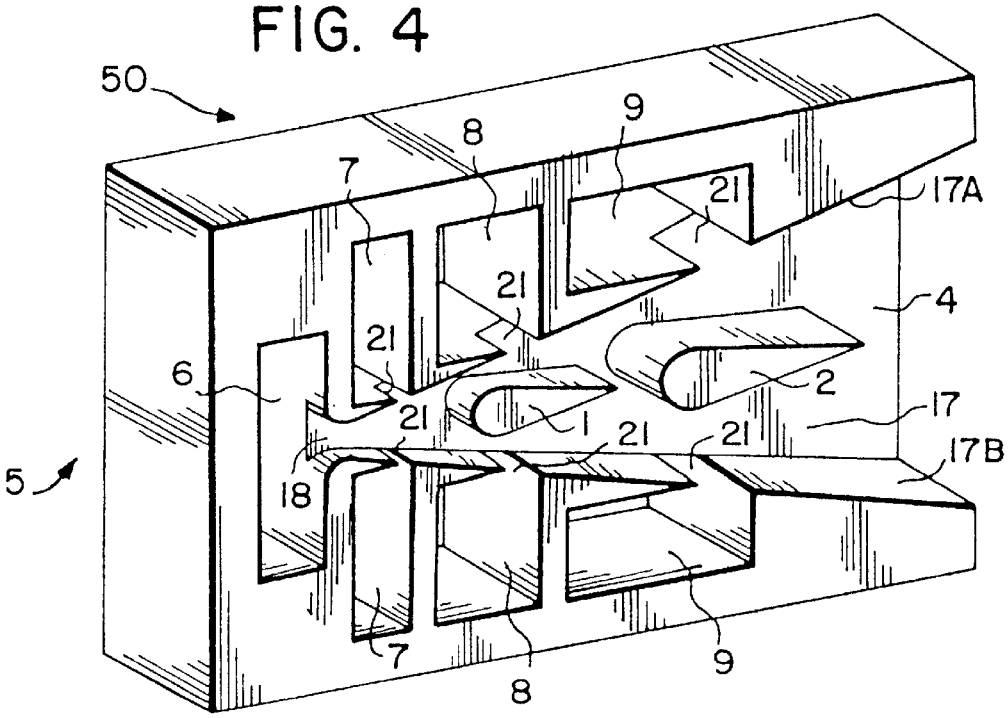
Figure 5:
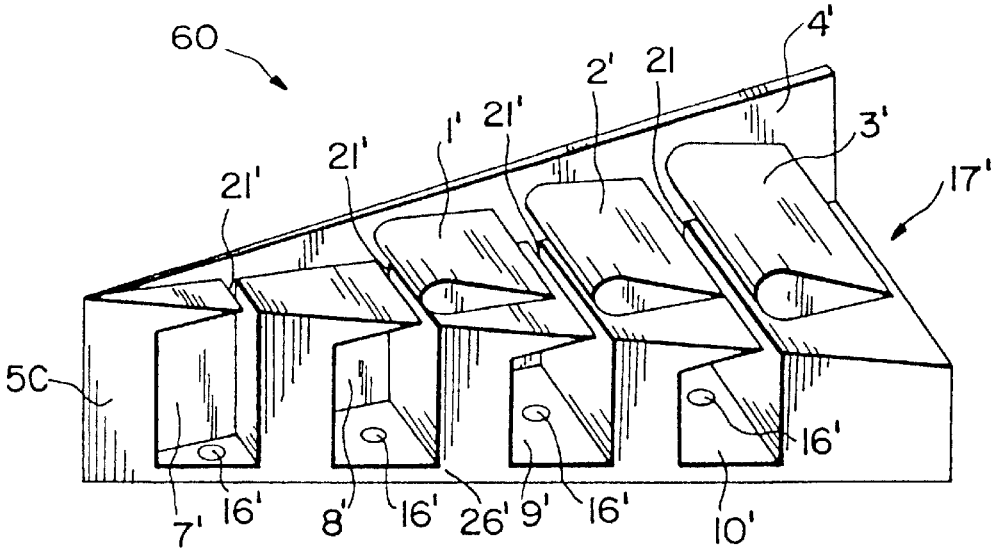
Figure 6:
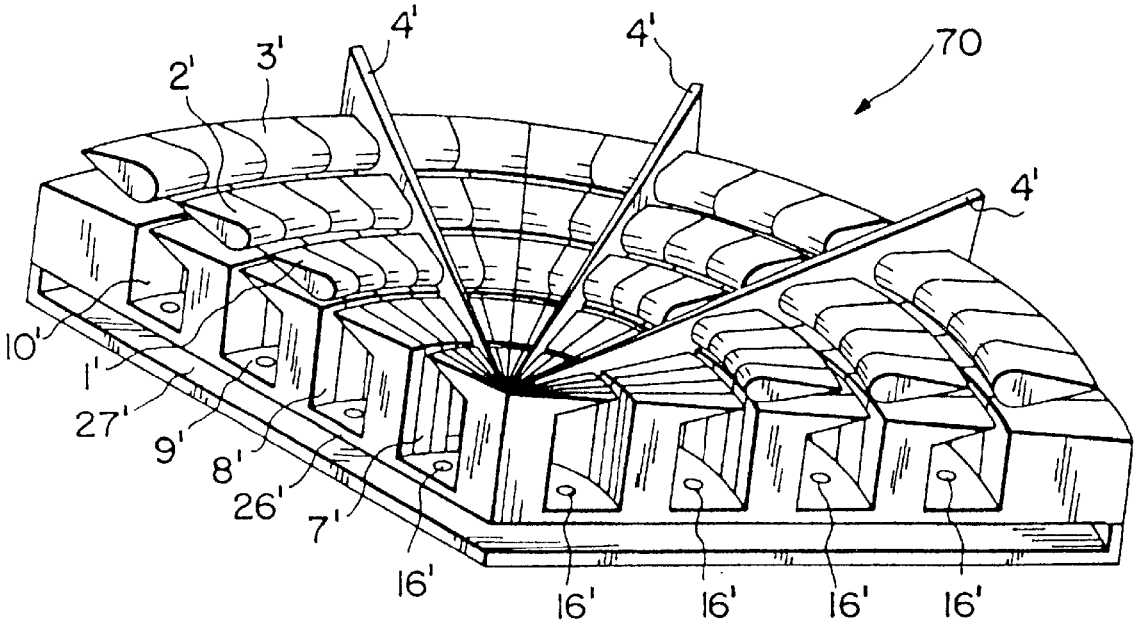

Further details, characterizing features, and the advantages of the subject of the invention are found in the following description of the associated drawing, in which an ejector pump in accordance with the invention is described. Shown in the drawing are the following:

FIG. 1 A four-stage ejector pump in accordance with the invention in a section view (section transversely through the flow channel and along the primary direction of flow within the flow channel);

FIG. 2 A perspective representation of a system of and dividing walls for the ejector pump in accordance with FIG. 1;

FIG. 3 For an alternative form of implementation of a multistage ejector pump with an annular flow channel that is directed towards the outside, a system of profiles and dividing walls (seen in the axial direction);

FIG. 4 A perspective representation of an ejector pump module for a three-stage flat-channel ejector pump that can be produced as a single piece by means of the injection molding process;

FIG. 5 A perspective representation of another ejector pump module for a four-stage radial ejector pump, and FIG. 6 A perspective representation of a radial ejector pump segment, in which the representation of the housing has been dispensed with for the sake of the clarity of the drawing.

The ejector pump 100 shown in FIG. 1 consists of a housing 5 made up of two identical housing parts 5A and 5B, which are identical, produced of metal by means of the extrusion process, arranged mirror-symmetrically to each other, and joined to each other. This housing includes a flow channel 17, which runs perpendicular to the plane of the drawing, is flat in cross-section, is straight, and expands conically from its inlet side for the driving medium at jet 18 to the outlet 22. By means of an entry chamber 6, and it in turn by means of an inlet 15, the slot-like jet 18 is impinged upon by a fluid driving medium which can be liquid, gaseous, or vaporous.

In the flow channel walls 17A and 17B, which are placed so they lie opposite each other and run conically from one another, there are found pass-through slots 21, which run perpendicular to the plane of the drawing, that is, parallel to the jet 18 (flat jet), for the medium to be transported, which is a material that can flow or a mixture of materials that can flow (liquid, gaseous, or vaporous). In order to impinge upon the pass-through slots with the fluid that is to be transported, suction chambers 7 through 10, which run parallel to the pass-through slots 21 inside the housing parts 5A and 5B, are fluidically connected on the one side with the flow channel by means of the pass-through slots 21, and on the other side, with the chamber that holds the fluid that is to be transported by means of inlets 16 that are at the front end. In accordance with FIG. 1, end walls 26 are therefore placed at the front.

The driving medium, which comes through the jet 18 (jet slot) into the flow channel 17 at a high velocity, creates in the suction chambers 7 through 10 a negative pressure by means of which the medium to be transported is sucked into the flow channel 17 and there mixes with the driving medium and flows along with it towards the outlet 22 of the flow channel 17. The inlets 16 or the pass-through slots 21 can be provided with check valves in the way in which they are generally familiar for multistage ejector pumps (see FR-A1-2 577 234), and which therefore do not require a more detailed explanation.

In the flow channel 17, there is adjoining (in the direction of flow) each of the opposing pass-through slots 22 of each pumping stage a mixing zone 19, and adjoining that, a diffuser (diffusion zone) 20. The mixing zone and the diffuser zone can overlap each other at least in part.

At the level of the pass-through slots of the second through fourth pumping stages, to which the suction chambers 8 through 10 belong, three mirror-symmetrical, elongated profiles 1 through 3, which are airfoil-shaped in cross-section, run perpendicular to the direction in which the flow channel runs (and thus perpendicular to the plane of the drawing) and exactly in the longitudinal center plane 17C of the flow channel 17. The cross-section of these three profiles, which act as flow management profiles, increases from profile to profile, viewed in the direction of flow. The round, head ends of the profiles act as the leading edge (as with an airfoil), while the pointed tail ends point in the direction of flow.

As a result of the volumes displaced by the profiles 1 through 3, a partial change in the direction of the approaching fluid is caused away from the primary direction of flow on both sides of the longitudinal center plane 17C within the flow channel 17 (see flow arrow in FIG. 1).

Each of the profiles 1 through 3 is found—seen in the direction of flow—at the same level as the pass-through slots 21 of the associated pumping stage, that is, the associated suction chamber 8 or 9 or 10. In conjunction with this, the location of the narrowest cross-section is located immediately upstream of the pass-through slot.

At profile 3, a special form of implementation of the invention is explained by way of example: Profile 3 is a profile which is hollow inside, the hollow space 23 of which functions as a suction chamber, and which is fluidically connected on the one side—by means of sidewall openings 24—with the flow channel 17, and on the other side—at the faces (end walls 26) by means of an inlet 16—with the space containing the fluid that is to be transported. In an extreme case, it is also possible, and to be considered as lying within the framework of the invention, to house the suction chambers only in the flow management profiles, in the way in which this was explained with the aid of the profile 3. In the same way, it is also conceivable to house the suction chambers in the flow channel walls 17A and/or 17B in part of the pumping stages, and in one or more other suction stages, to house the suction chamber, of which there is at least one, in the associated flow management profile, of which there is at least one. In the same way, it is also conceivable to arrange the flow management profiles not only one after the other in the direction of flow, but instead of this or as a supplement to this, to arrange them along side each other as well, and to allow the flow to pass, in the direction of the outlet end of the flow channel, between the profiles that have been placed along side each other.

The profiles 1 through 3 which serve as flow management profiles can be fastened inside the ejector pump 100 in the most widely varying ways. Proving to be especially advantageous for this purpose are elongated dividing walls 4, which also serve as flow management profiles (FIG. 2) and which in their longitudinal direction run approximately parallel to the direction in which the flow channel runs, and which thus run approximately parallel to the primary direction of flow of the fluid in the flow channel and subdivide the flow channel cross-section into partial flow channels 17', 17", 17''', . . . , as is indicated in FIG. 2. It is possible—possibly in addition—to use for fastening the profiles 1 through 3 the dividing walls 4', which taper in the direction of flow. As a result of these measures, the side surfaces 4*a*, 4*b* of the dividing walls 4' that limit the one flow channel 17" run approximately conically from one another, as a result of which the entry cross-section of the jet 18 can be kept as small as possible and the efficiency of the ejector pump can be increased.

In FIG. 1, dividing walls 4 of the that type which serve as flow management profiles are drawn by a solid line broken with double dashes. In the implementation example shown, the dividing walls 4 primarily assume the following three functions:

First, they provide the profiles 1 through 3 with support, and prevent them from oscillating from the effects of the flow turbulence that develops in the flow channel.

Second, the housing 5 can be mechanically stabilized by them as well.

Third, they reduce the spread of the flow turbulence into the mixing zones, and thereby shorten the required flow channel length, as seen in the direction of flow. They therefore improve the flow characteristics in the sense of the invention, even without the presence of the profiles 1 through 3 that are oriented perpendicular to them, and as such, they can be used alone as well.

The system, shown in FIG. 2, of transverse and longitudinal profiles 1 through 3 and dividing walls 4 that can be built into the flow channel 17, can be manufactured and assembled in a simple way by virtue of the fact that each one of the dividing walls is provided with the profiles 1 through 3 on one or both sides, and specifically, is manufactured together with them as one piece, in conjunction with which corresponding guides, in the form of holes and dowel pins 25 which are aligned with each other, are provided on the opposite dividing walls and the free ends of the profiles 1 through 3. It is even possible, and especially advantageous, to manufacture complete segments or ejector pump modules 50, 60, consisting of the corresponding segments of the ejector housing and the flow management profiles, as shown in FIGS. 5 and 6, as a single component, out of plastic for example, and to provide it with end walls or to join it together with additional such segments or modules in order to attain the desired or necessary pumping capacity. Beyond that, it is also possible to make the number of stages of the pump variable by means of the fact that the ejector housing and the flow management profiles can be separated and joined together approximately perpendicular to the primary direction of flow (A) (see the schematically shown dividing line B, shown by means of a dashed line in FIG. 1).

The implementation example in accordance with FIG. 3 shows how the system of flow management profiles 1 through 4 in accordance with FIG. 2 can also be formed in a circular fashion instead of running straight.

With the ejector pump module 60, which is shown in perspective in FIG. 5, an ejector pump in the shape of a circle or of a segment of a circle can be built up—as has already been mentioned—by joining to one another several ejector pump modules 60.

The ejector pump module 60 that is manufactured as one piece is comprised of a housing part 50, which exhibits a horizontal projection in the shape of a segment of a circle and in which are integrated—near the top of FIG. 5—the suction chambers 7' through 10', which are joined with the flow channel 17' by means of the pass-through slots 21'. The termination of the chambers 7' through 10' in the axial direction—that is, towards the bottom of FIG. 5—is formed by an end wall 26', which exhibits in each suction chamber at least one inlet 16' for the medium to be transported, which inlet can in turn be equipped with a check valve. As is shown in FIG. 6, the inlets 16' join the suction chambers 7' through 10' with a chamber 27', which is placed beneath the end wall 26' and which serves as a distribution chamber for the fluid to be transported. Corresponding to the implementation example in accordance with FIG. 1, there are provided in the axial direction and to the side of—that is, in the top half of FIG. 5—the second through the fourth pass-through slots 21', profiles 1' through 3', which are supported at a radial dividing wall 4' of the housing 5C, which wall simultaneously closes off the suction chamber chambers 7' through 10' in the axial direction. The remaining open side of the suction chamber chambers 7' through 10' are closed by the separating wall 4' of the next (connected to it) ejector pump module 60. The upper termination of the ejector pump is formed—in a way similar to the form of implementation in accordance with FIG. 1—by a housing upper part (not shown) that exhibits in its center a—also not shown in the drawing—entry jet for the driving medium. The housing upper part can be comprised of a simple, lid-like component; it can, however, also be advantageous to place in the housing upper part additional suction chambers, which are opposite the suction chambers 7' through 10' and which are likewise joined with a chamber that holds the fluid that is to be transported.

It is understood to be in the sense of the invention, that the pass-through slots 21 can also be realized in the form of openings that lie adjacent to one another, and that the openings 24 can also be realized as pass-through slots, and that as a result, the pass-through slots 21 at the suction chambers and the openings 24 at the hollow flow management profiles are to be considered means that act in the same way.

As an alternative to the implementation example in accordance with FIG. 1, it is also comes into consideration to form the flow channel walls 17A, 17B in the region of the diffuser 20 concave when seen transversely to the primary direction of flow, that is, hollow—and thus with a certain corresponding matching of the surface of the profiles 1 through 3, which is convex in this region. As a result of these measures, it is possible to have an advantageous effect on the course of the flow in the diffuser and the suction action at the subsequent pass-through slot 21. By way of example, a shaping of the flow channel wall of that type is shown by means of a dashed line 17A' in FIG. 1 at the flow channel wall 17A at the level of the profile 3.

List of Reference Symbols

| | | |
|---|---|---|
| 1 | Profile | A Primary direction of flow |
| 2 | Profile | B Dividing line |
| 3 | Profile | |
| 4 | Dividing wall | |
| 5 | Ejector housing | |
| 5A | Housing part | |
| 5B | Housing part | |
| 5C | Housing part | |
| 6 | Entry chamber | |
| 7 | Suction chamber | |
| 8 | Suction chamber | |
| 9 | Suction chamber | |
| 10 | Suction chamber | |
| 15 | Inlet (driving medium) | |
| 16 | Inlet (mixture of materials) | |
| 17 | Flow channel | |
| 17A | Flow channel wall | |
| 17B | Flow channel wall | |
| 17C | Longitudinal center plane | |
| 18 | Jet | |
| 19 | Mixing zone | |
| 20 | Diffuser | |
| 21 | Pass-through slot | |
| 22 | Outlet | |
| 23 | Suction chamber | |
| 24 | Openings | |
| 25 | Guide pins | |
| 26 | End wall | |
| 100 | Ejector pump | |
| 50 | Ejector pump module | |
| 60 | Ejector pump module | |
| 70 | Ejector pump | |
| 27 | Chamber | |

I claim:

1. Ejector pump for the sucking or transporting of materials or mixtures of materials which are capable of flowing with the aid of a fluid driving medium, within a housing comprising:

at least one inlet for the driving medium, at least one inlet for the materials located downstream of said inlet for said driving medium, at least one flow channel having opposite side walls and a middle portion therebetween, said flow channel for the mixing and joint flowing through of the driving medium and the materials, said flow channel including at least one jet, at least one mixing zone, and at least one diffusing zone between said opposite side walls, at least one suction chamber, which is fluidly joined with the inlet for the materials on a first side, and with the flow channel on a second side from which said materials are drawn by vacuum created by said driving medium in said flow channel, at least one common outlet for the driving medium and the materials downstream of said flow channel, wherein an original direction of flow is defined by a line extending between said inlet for said driving medium and said common outlet, at least one elongated dividing wall that is placed in the flow channel and that runs in a longitudinal direction between said at least one inlet for the driving medium and said at least one common outlet, which is generally parallel to the original direction of flow and subdivides the flow channel cross-section into flow channel partial channels, and at least two flow management profiles placed in each of the flow channel partial channels and which displace the fluid that is flowing against the profiles and guide it with a lateral direction component away from said original direction of flow, so that the fluid in the middle portion of said flow channel partial channel makes its way closer to one of the flow channel partial channel dividing walls, said two profiles having the shape of a teardrop in cross-section to decrease turbulence in said flow channel partial channel.

2. The ejector pump according to claim 1, wherein the thickness of said dividing wall tapers from a smaller thickness to a larger thickness along the original direction of flow.

3. The ejector pump according to claim 1, wherein said pump includes ejector pump modules that are assembled together, each module having a housing including said flow channel, said at least one jet, said at least one suction chamber, said dividing wall, and said two profiles.

4. The ejector pump according to claim 3, wherein each said ejector pump module is a single piece.

5. The ejector pump according to claim 1, wherein said ejector pump is manufactured by means of the joining together of individual ejector pump modules.

6. The ejector pump according to claim 1, wherein said at least one dividing wall has opposite side surfaces and said at least one dividing wall is provided with said at least two flow profiles on both said opposite side surfaces.

* * * * *